US012398544B2

(12) United States Patent
Weis

(10) Patent No.: US 12,398,544 B2
(45) Date of Patent: Aug. 26, 2025

(54) SUPPORT PART, CONSTRUCTION KIT FOR PIECE OF FURNITURE, PIECE OF FURNITURE, AND CORRESPONDING USE

(71) Applicant: Neoperl GmbH, Müllheim (DE)

(72) Inventor: Christoph Weis, Müllheim (DE)

(73) Assignee: NEOPERL GMBH, Mullheim (DE)

( * ) Notice: Subject to any disclaimer, the term of this patent is extended or adjusted under 35 U.S.C. 154(b) by 427 days.

(21) Appl. No.: 17/918,633

(22) PCT Filed: Apr. 14, 2020

(86) PCT No.: PCT/EP2020/060462
§ 371 (c)(1),
(2) Date: Oct. 13, 2022

(87) PCT Pub. No.: WO2021/209118
PCT Pub. Date: Oct. 21, 2021

(65) Prior Publication Data

US 2023/0142779 A1 May 11, 2023

(51) Int. Cl.

| | |
|---|---|
| ***E03C 1/04*** | (2006.01) |
| ***A47B 57/30*** | (2006.01) |
| ***A47B 96/02*** | (2006.01) |
| ***E03C 1/02*** | (2006.01) |

(52) U.S. Cl.
CPC ..... *E03C 1/0401* (2013.01); *A47B 57/30* (2013.01); *A47B 96/024* (2013.01); *E03C 1/021* (2013.01); *A47B 2220/03* (2013.01)

(58) Field of Classification Search
CPC ..... E03C 1/0401
See application file for complete search history.

(56) References Cited

U.S. PATENT DOCUMENTS

| | | | | |
|---|---|---|---|---|
| 1,719,386 | A * | 7/1929 | Bence | A47K 5/1214 73/306 |
| 1,745,209 | A * | 1/1930 | Donovan | A47B 67/02 604/259 |
| 1,840,033 | A | 1/1932 | Hampton | |
| 2003/0079282 | A1 * | 5/2003 | Piatt | A47B 67/005 4/661 |

FOREIGN PATENT DOCUMENTS

| | | |
|---|---|---|
| CN | 1589116 | 3/2005 |
| CN | 203784403 | 8/2014 |
| CN | 204764316 | 11/2015 |
| CN | 109843141 | 6/2019 |
| DE | 20009957 | 8/2000 |
| EP | 3064658 | 9/2016 |
| FR | 2866546 A1 | 8/2005 |
| JP | 411169309 A | 6/1999 |

* cited by examiner

*Primary Examiner* — Lauren A Crane
(74) *Attorney, Agent, or Firm* — Volpe Koenig

(57) ABSTRACT

A support part (1) is provided in which a liquid outlet (9) is disposed on an outer face (4, 5) of the support part (1), with the liquid outlet (9) preferably opening outwards on the lower face (5) of the support part (1).

19 Claims, 3 Drawing Sheets

SUPPORT PART, CONSTRUCTION KIT FOR PIECE OF FURNITURE, PIECE OF FURNITURE, AND CORRESPONDING USE

INCORPORATION BY REFERENCE

The following documents are incorporated herein by reference as if fully set forth: PCT Application No. PCT/EP2020/060462, filed Apr. 14, 2020.

TECHNICAL FIELD

The invention relates to a support part for a piece of furniture. The invention further relates to a construction kit for a piece of furniture and a piece of furniture.

BACKGROUND

Such support parts are known, for example, as shelves in furniture systems and other pieces of furniture, in particular cabinets or shelves.

It is known to provide such support parts with lighting means in order to achieve interesting visual effects, in particular when using transparent doors.

It is known to combine pieces of furniture, in particular as furniture systems, from individual parts such as support parts, for example as parts of carcasses, doors, drawers and the like. To this end, for an industrial production of individual parts it is advantageous if the individual parts form a construction kit for a piece of furniture in which one and the same individual part is able to be used in different variants of pieces of furniture.

SUMMARY

The object of the invention is to increase the design options in pieces of furniture.

To achieve this object, one or more of the features disclosed herein are provided. In particular, therefore, to achieve the object in a support part of the type mentioned in the introduction it is proposed according to the invention that the support part has a liquid outlet which is arranged at least indirectly on an outer face of the support part, in particular is fastened to the outer face. The outer face on which the liquid outlet can be arranged, and in particular can be fastened, can for example be an upper face, a lower face or even a transverse face of the support part.

The liquid outlet can be arranged, in particular fastened, for example, by means of a holder on the outer face of the support part. The holder can have a fastening interface and/or a receiver. The holder can be fastened in a simple manner to the support part via the fastening interface. The liquid outlet can be arranged in the receiver of the holder.

In one embodiment of the support part, it is provided that the liquid outlet is arranged entirely outside an imaginary envelope of the support part. Thus the liquid outlet can be arranged as a separate part on an outer face of the support part, for example of a shelf, and fastened to this outer face without having to provide a recess or depression for receiving the liquid outlet in the support part. Thus any support parts can be provided with a liquid outlet without previous adaptations.

To achieve this object, additional features disclosed herein relating to a support part are provided according to the invention. In particular, therefore, to achieve the object in a support part of the type described in the introduction it is also proposed according to the invention that the support part has a connection line to a liquid outlet, for example the aforementioned liquid outlet, which at least in some portions is arranged, in particular fastened, on an outer face, in particular on an upper face or on a lower face or on a transverse face, of the support part. In this case or alternatively, the connection line can also protrude from the outer face, i.e. for example the connection line can be laid so as to be partially embedded therein.

The connection line in this case is preferably arranged on the same outer face as the liquid outlet. A through-passage through the support part in order to connect the connection line to the liquid outlet is thus unnecessary, which minimizes the production effort.

It is particularly advantageous if the connection line is arranged entirely outside an imaginary envelope of the support part. Thus any line conduit to be introduced into the support part can be dispensed with.

All of the above-described variants of support parts disclose a structurally simple manner of integrating a water-conducting functionality into a piece of furniture without the piece of furniture itself having to be water-resistant.

A further advantage of the invention can be seen in the fact that a metal base body of a fitting can be dispensed with. Thus weight can be saved, which has an advantageous effect on transportability and/or manufacturing costs.

In one embodiment of the support part, a line conduit which is configured in the support part is provided. A portion of the connection line can be arranged in the line conduit. The portion of the connection line arranged in the line conduit can thus be integrated in a particularly inconspicuous and space-saving manner.

The liquid outlet can be designed for dispensing water in pure form or with additional components of beverages, cleaning agents or other liquid substances.

The liquid outlet can be configured in this case as an angled piece. Thus an inflow direction is able to be diverted along the support part into an outflow direction transversely to the support part.

In one advantageous embodiment, it can be provided that the support part is configured in a plate-shaped manner. Thus it is possible to achieve a compact design in which the piece of furniture does not have to have larger dimensions after being provided with a water-conducting functionality according to the invention. The invention in this case has recognized that the at least one connection line and the liquid outlet can be arranged, in particular fastened, in a simple manner on a plate-shaped structure. In particular, it can be provided that the support part is configured as a fitted shelf. Thus the liquid outlet can be positioned in a flexible manner.

In an advantageous embodiment, it can be provided that the support part is releasably connected to a body of the piece of furniture. It is advantageous here that the support part can be easily replaced, for example for maintenance purposes, and/or the support part can be easily retrofitted.

In an advantageous embodiment, it can be provided alternatively or additionally here that the support part is arranged movably on a body of the piece of furniture, for example on the aforementioned body. As a result, it is possible to configure the support part, for example, to be horizontally and/or vertically displaceable. A horizontal displaceability, for example similar to a drawer, can be advantageous in order to fill containers having a large volume in an improved manner. A vertical displaceability can be advantageous in order to fill tall containers in an improved manner. Particularly advantageously, a respectively stepless adjustability can be implemented here. It is also possible to combine such a displaceability with a corresponding displaceability of a wash basin.

The support part can also be arranged rotatably or pivotably, for example, about a horizontal or vertical axis. This permits the formation of a liquid-conducting functionality which can be folded away. It is also possible to combine such pivotability with a corresponding pivotability of a wash basin. Thus the liquid-conducting functionality can be provided in a very space-saving manner outside of use.

In an advantageous embodiment, it can be provided that the support part is configured as part of a body of the piece of furniture. Thus an alternative is described as to how the at least one connection line can be integrated in a simple manner, without having to increase the external dimensions substantially.

In an advantageous embodiment, it can be provided that an actuating mechanism for a valve blocking or opening the at least one connection line is arranged on the piece of furniture. Thus the liquid outlet is able to be switched off and switched on in a simple manner. For example, the actuating mechanism can be arranged on the support part. It is advantageous here that it is possible to provide a functional unit which can be retrofitted or installed in a simple manner without specific specialist knowledge of the water connection being required. In this case, the valve can also be configured as a temperature-dependent switching valve and/or as a mixing valve.

In an advantageous embodiment, it can be provided that a valve, for example the aforementioned valve, is fastened to the support part. It is advantageous here that the water-conducting functionality is fastened in a simple manner and can be fitted to the support part. The valve, as is the case of the aforementioned connection line and above all the liquid outlet, can also be arranged here on an outer face, preferably on the same outer face as the liquid outlet and/or the outlet line.

It is particularly advantageous if both the liquid outlet and the valve are fastened to the support part. As a result, the at least one connection line which can connect the valve and the liquid outlet can be relieved of strain.

In an advantageous embodiment, it can be provided that a valve, for example the aforementioned valve, is connected to the liquid outlet via a flexible hose which then can form at least one portion of a connection line, for example the aforementioned connection line. Thus it is possible to achieve a simple layout and fastening of the valve and the liquid outlet to the support part.

In an advantageous embodiment, it can be provided that the support part is produced from wood and/or wood fibers or at least laminated on the outer face with wood or configured so as to contain wood. Thus interesting design options are opened up, for example in the kitchen and bathroom area. For example, the support part can be produced from a composite material, in particular from WPC (wood plastic composite, wood polymer composite).

The support part can also be produced from sheet metal, metal, ceramic, acrylic and/or polymer, for example in a sandwich construction, in particular in combination with a wood-containing component. The support part can also be milled, cast and/or glued together. Thus robust furniture can be formed.

In an advantageous embodiment, it can be provided that the one portion of the connection line is arranged between the upper face and the lower face of the support part. For example, in this case it can be provided that the connection line is arranged so as to be concealed in some portions. Thus a surface on which the connection line is arranged can be used for further purposes, for example as a storage area, and/or designed in a visually attractive manner and/or easily looked after and cleaned.

In an advantageous embodiment, it can be provided that the aforementioned line conduit is milled into the support part. Thus the line conduit is able to be manufactured by machine and/or in an industrial production process.

In an advantageous embodiment, it can be provided that the line conduit is arranged between two panels forming the upper and lower face. In this case, it can be provided that the line conduit is configured in a cavity structure, for example a honeycomb structure or a lamella structure. The invention makes use of the fact that cavities are able to be used in a lightweight structure for the at least one connection line and accessories.

In an advantageous embodiment, it can be provided that an actuating mechanism, for example the aforementioned actuating mechanism, has a pilot valve, the valve being able to be controlled thereby as a principal valve. Thus a switching on and switching off can be carried out in a simple manner with a small actuating force. In this case, the invention makes use of the fact that with a pilot valve an actuating force can be increased by a pressure of incoming water.

In an advantageous embodiment, it can be provided that at least one control line of the pilot valve is arranged on an outer face of the support part or in a control line conduit in the support part. Thus the pilot valve can be arranged spaced apart from the principal valve, for example outside the support part. For example, a plurality of control lines can be provided in order to form a mixing valve.

A particularly simple design of an existing support part with such a control line is thus provided when the control line is arranged entirely outside an imaginary envelope of the support part. Thus the control line can be fastened to the support part without having to introduce a control line conduit into the support part beforehand.

In an advantageous embodiment, it can be provided that an actuating element of the valve or a pilot valve, for example the aforementioned pilot valve, is guided outwardly in the support part. This can be provided, for example, via a mechanical, magnetic or electrical, in particular inductive, capacitive or galvanic, coupling.

Alternatively or additionally, it can be provided that the actuating element is guided outwardly on a side edge of the support part. Thus the actuating element can be positioned in an easily accessible manner.

In an advantageous embodiment, it can be provided that the liquid outlet is a water outlet. Thus it is possible to configure a water conduit.

In particular, for forming a piece of a furniture system in which a user can undertake assembly himself, a preferred application provides a construction kit for a piece of furniture having at least one support part according to the invention, in particular as described above and/or according to one of the claims relating to a support part. Thus an assembly can be carried out in a simple manner outside a production workshop even by non-specialist personnel. Thus a modular system can also be formed by, for example, a uniform support part being able to be used with the water-conducting functionality with different piece of furniture, for example at different overall heights.

By means of the invention, therefore, a piece of furniture can be formed with at least one support part according to the invention, in particular as described above and/or according to one of the claims relating to a support part. This permits a space-saving integration of a water-conducting functionality in pieces of furniture, such as for example book shelves, and separate washstands and the like can be dispensed with. This can be advantageously used, in particular, when furnishing a narrowly restricted living area.

In an advantageous embodiment, it can be provided in the piece of furniture that a wash basin is arranged below the support part. Thus a discharge of exiting water can also be integrated in a simple manner in the piece of furniture. A washstand or a sink are thus able to be integrated in a simple manner in a conventional piece of furniture.

In an advantageous embodiment, it can be provided in the piece of furniture that the support part is arranged in a height-adjustable manner on the piece of furniture. Thus an exit height, for example above a wash basin, can be integrated in a simple manner.

In an advantageous embodiment, it can be provided in the piece of furniture that the valve can be connected to a water removal point via a line laid in or behind a wall of the piece of furniture. Thus a supply of water can be concealed in a simple manner from a user. For example, it can be provided that the line is laid in a rear wall or behind a rear wall, for example thereon. The invention makes use of the fact here that sufficient space is frequently provided on the rear wall or in the rear wall for receiving the line. The line can thus be guided in a simple manner to the floor. It can be connected therefrom to a water removal point, for example an angle valve.

A preferred application provides a use of a support part according to the invention, in particular as described above and/or according to one of the claims relating to a support part, of a piece of furniture for fastening a water outlet and at least one connection line. A water-tight design of the support part or other parts of the piece of furniture is thus not required.

BRIEF DESCRIPTION OF THE DRAWINGS

The invention is now described in more detail with reference to exemplary embodiments, but is not limited to these exemplary embodiments. Further exemplary embodiments emerge from the combination of the features of individual or a plurality of protected claims with one another and/or with individual or a plurality of features of the exemplary embodiments.

In the drawings.

DETAILED DESCRIPTION

Figure 1:
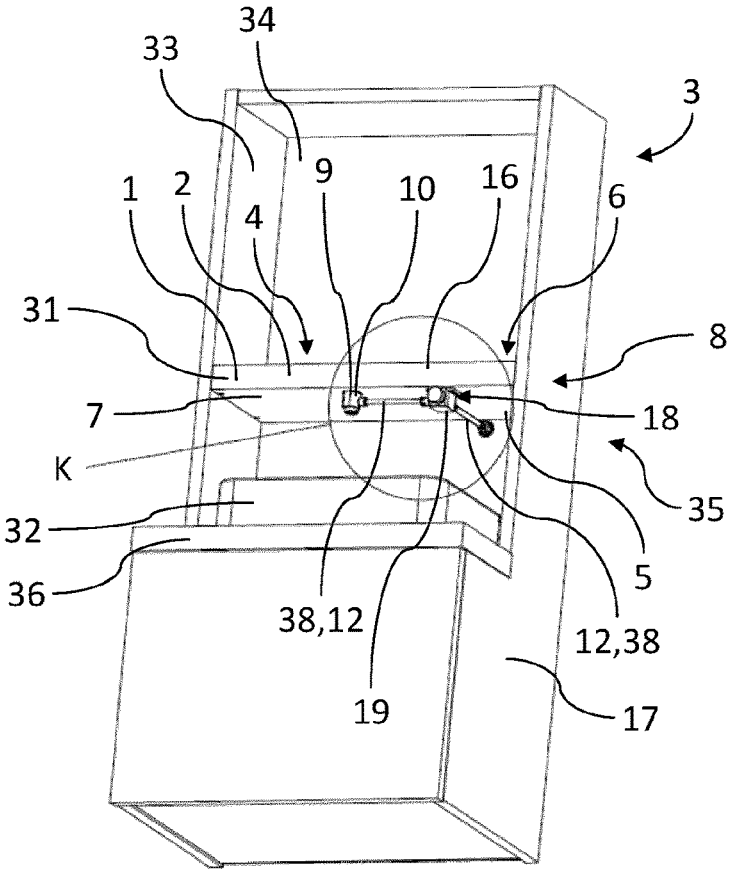
FIG. 1 shows a perspective view of a piece of furniture with a support part according to the invention, a first embodiment of a liquid conducting arrangement with a liquid outlet, a connection line and a valve being fastened to the lower face thereof.

A support part 1 according to the invention, designed here by way of example as a shelf 2, is configured as part of a piece of furniture 3 (see FIG. 1).

The support part 1 has an upper face 4 and a lower face 5 which can be defined by the use position of the support part 1 on the piece of furniture 3. A liquid outlet 9 is arranged on the lower face 5, said liquid outlet being oriented downwardly so that a liquid, for example water, can flow out from the liquid outlet 9 transversely or perpendicular to the lower face 5 of the support part 1. The liquid outlet 9 is fastened by means of a holder 10 to the lower face 5 of the support part 1. The holder 10 has a fastening interface and a receiver 11. The holder 10 is fastened via its fastening interface to the lower face 5 of the support part 1 in order to fasten the liquid outlet 9 at least indirectly to the support part 1 in this manner. In the use position, the liquid outlet 9 is arranged in the receiver 11 of the holder 10.

A connection line 12 is fastened to the lower face 5 of the support part 1. Both the connection line 12 and the liquid outlet 9 are arranged entirely outside an imaginary envelope of the support part 1. The liquid outlet 9 is connected to the connection line 12 for the supply of liquid, in this case water. The liquid outlet 9 and the connection line 12 form together with a valve 19, described in further detail below, a liquid-conducting arrangement 8.

The liquid outlet 9 in the exemplary embodiment is configured as an angled piece 13. The angled piece 13 diverts an inflow direction, which runs between the upper face 4 and the lower face 5 parallel thereto, into a outflow direction.

Figure 2:
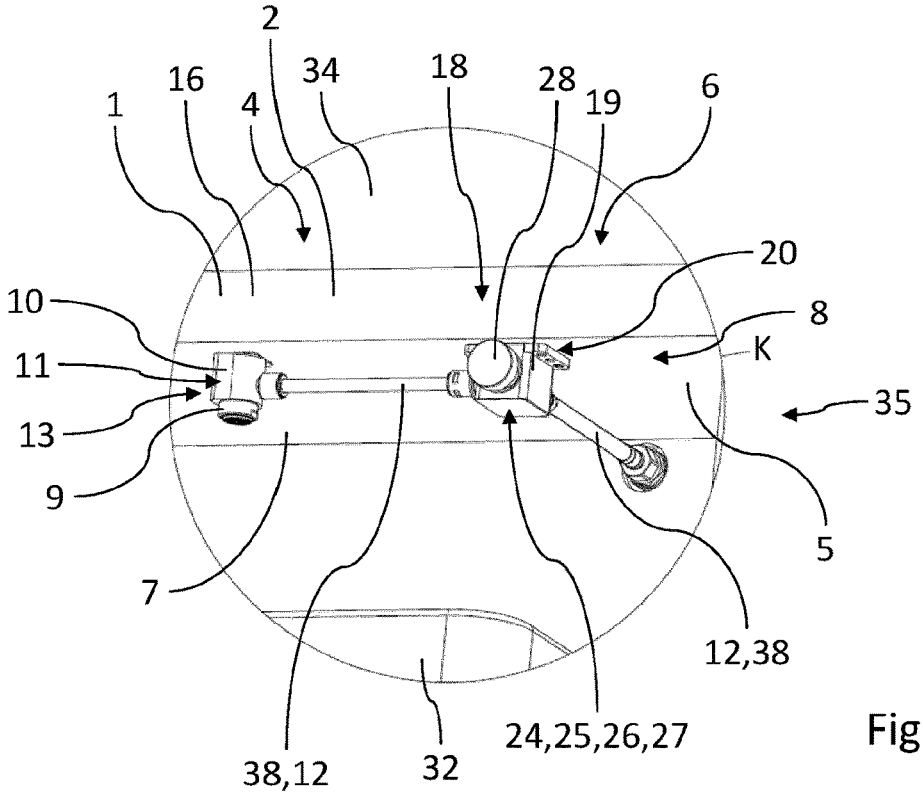
FIG. 2 shows the detail marked in FIG. 1 with the circle K in enlarged view.
Figure 3:
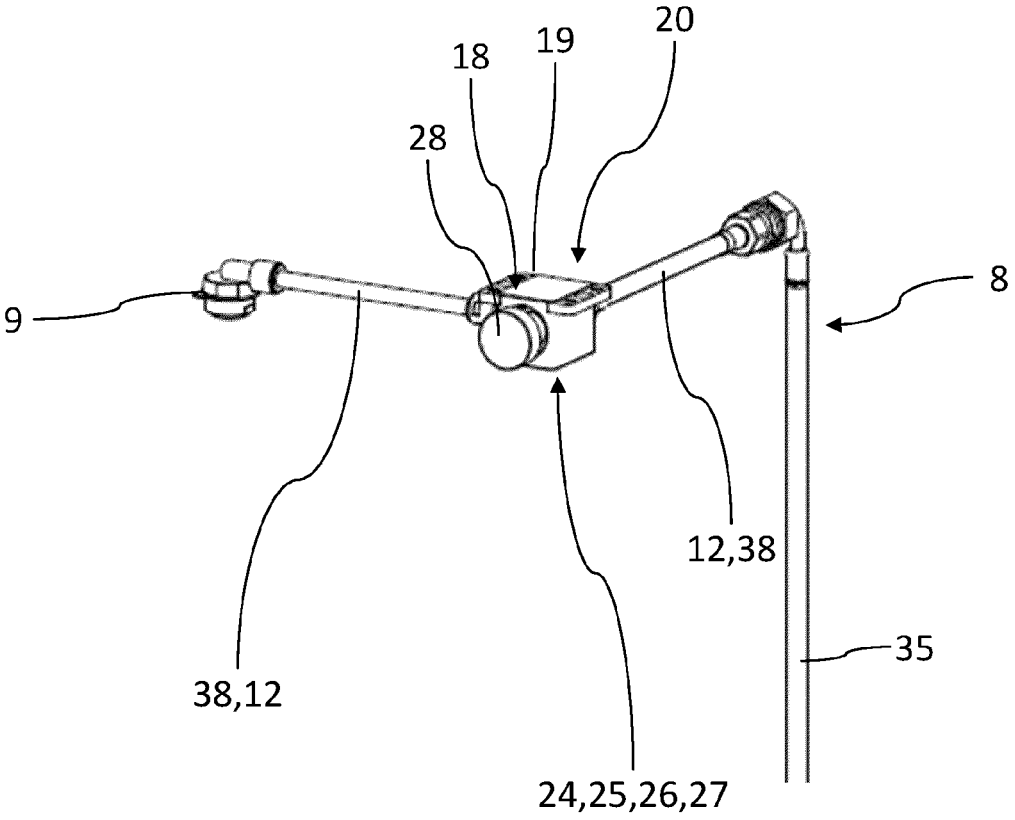
FIG. 3 shows a first perspective detailed view of the liquid outlet illustrated in FIGS. 1 and 2 with the connected connection line and a valve.
Figure 4:
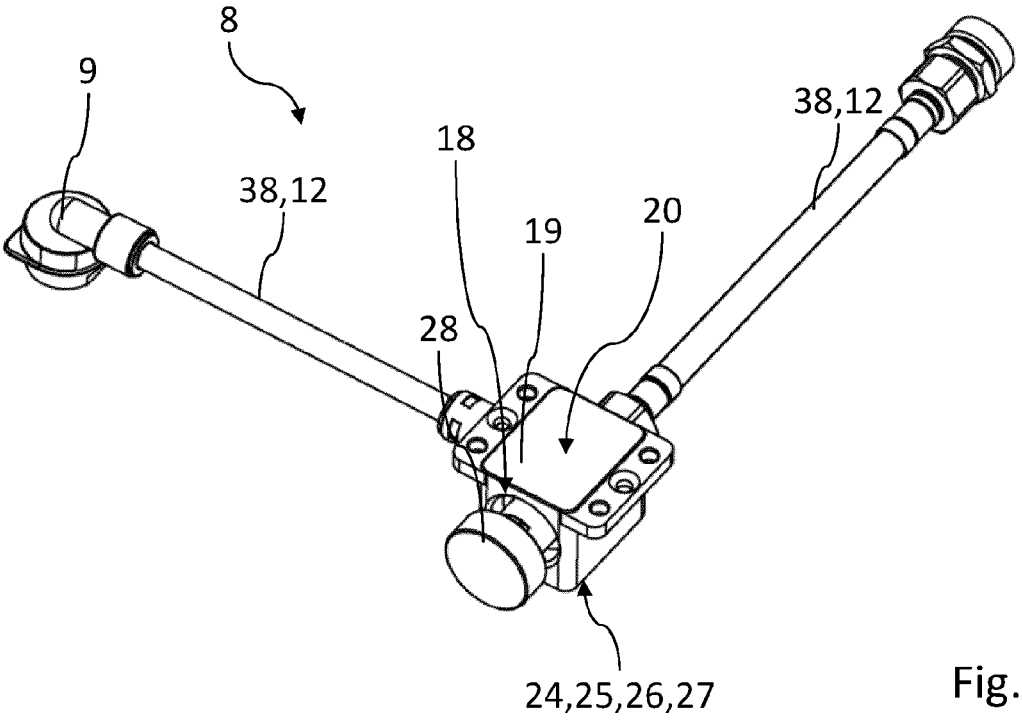
FIG. 4 shows the view shown in FIG. 3 from a perspective obliquely from above, wherein a mounting plate of the valve can be identified by which the valve in FIGS. 1 and 2 is fastened to an outer face of the support part, namely to a lower face of the support part.

FIGS. 1 and 2 show a possible use of the support part 1 on a piece of furniture 3.

The support part 1 is configured as a fitted shelf 16 which is inserted into a body 17 of the piece of furniture 3. In further exemplary embodiments, the support part 1 is configured as part of the body 17, for example as part of a side wall or an upper face or a lower face or a stabilizing wall between the upper face and the lower face.

In FIGS. 1 to 5 it can be seen that an actuating mechanism 18, by which a valve 19 can be actuated, is arranged on the support part 1.

The valve 19 can be connected via a flexible hose to the liquid outlet 9. In the exemplary embodiment shown in the figures, a portion of the connection line is formed between the valve 19 and the liquid outlet 9 by a pipe 38 which leads at its other end into the liquid outlet 9.

The liquid outlet 9 and the valve 19 are fastened to the lower face 5 of the support part 1. In order to fasten, for example to screw, the valve 19 to the lower face 5 of the support part 1, the valve has on its upper face a fastening interface 20.

A further portion of the connection line 12 is also configured as a rigid pipe 38. This portion connects the valve 19 to a line 35 which runs on a rear face of a rear wall 34 of the piece of furniture 3. In further exemplary embodiments, the at least one connection line 12 is configured as a flexible hose.

The valve 19 has a pilot valve 24, a principal valve 25 of the valve 19 being able to be controlled thereby. To this end, the principal valve 25 has a membrane which can be controlled by a water pressure which is applied to the principal valve 25 as a function of a switching position of the pilot valve 24.

To this end, a control line 26 is configured in the interior of the valve 19, water being able to be conducted thereby into or out of a pressure chamber 27 which is defined by the membrane. The control line 26 in this case can be configured in the aforementioned membrane as a pressure relief opening. In further exemplary embodiments, the at least one control line is configured as a separate control line.

The pilot valve 24 is able to be actuated via an actuating element 28 of the actuating mechanism 18.

FIGS. 1 to 4 show the case where the actuating element 28 is directly configured on the pilot valve 24.

Figure 5:
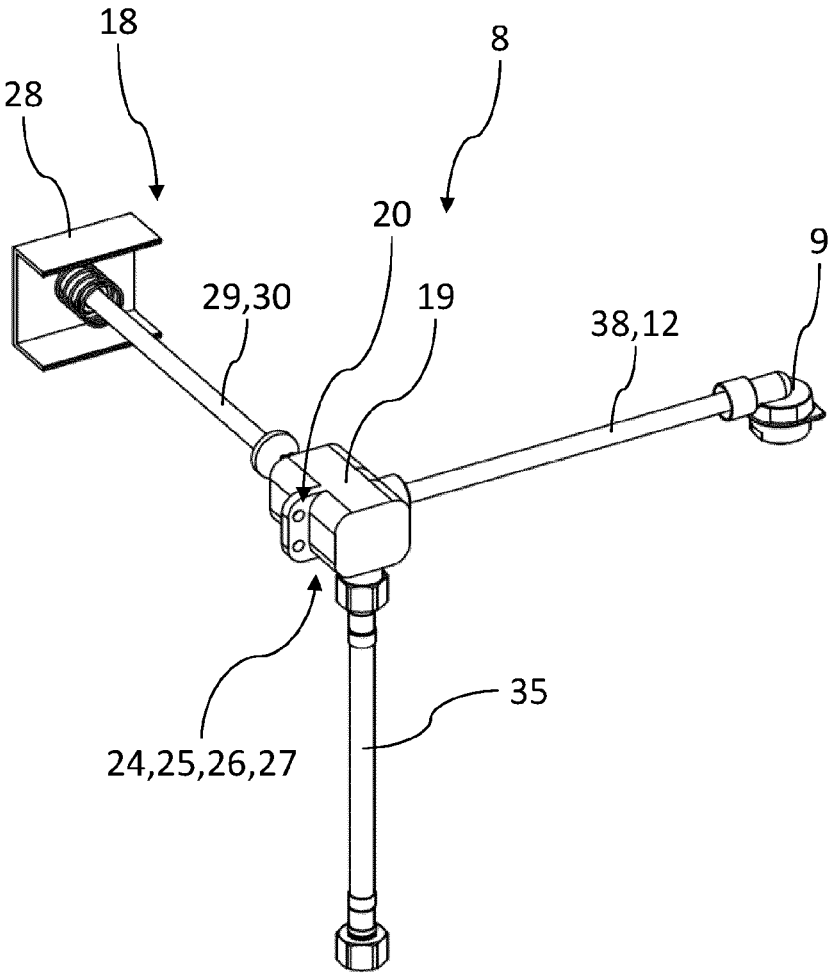
FIG. 5 shows an alternative liquid-conducting arrangement comprising a liquid outlet, a valve, a connection line and an actuating element which is connected to the valve via a mechanical coupling for actuating the valve.

FIG. 5 shows the case where the actuating element 28 is mechanically coupled to the pilot valve 24 via a mechanical coupling 29 which comprises a control rod 30.

In further exemplary embodiments, the actuating element 28 is coupled in a different manner to the valve 19, for example via a Bowden cable or a gear mechanism.

According to the exemplary embodiment shown in FIGS. 1 to 4, the actuating element 28 is configured below a front outer face 31 of the support part 1. In further exemplary embodiments, the actuating element 28 is arranged on the upper face, the lower face and/or a different side edge.

The support part 1 which is described and shown forms a part of a construction kit for a piece of furniture, the piece of furniture 3 shown in FIGS. 1 and 2 for example being able to be assembled thereby.

FIG. 1 illustrates that a wash basin 32 is arranged below the liquid outlet 9.

The body 17 has in each case side walls 33 and the rear wall 34 already mentioned above. A line 35 is guided through the rear wall 34.

The valve 19 is thus able to be connected via the line 35 to a water removal point, not shown further, for example a fitting or an angle valve.

In an exemplary embodiment, not shown in the figures, the support part 1 can be fastened as a fitted shelf 16 at different heights on the body 17. According to FIG. 1, the piece of furniture 3 has a hole in its rear wall 34 at the appropriate position of the fitted shelf 16.

In a further exemplary embodiment, the rear wall 34 can be assembled from a plurality of individual parts, wherein for example an individual part is configured with a hole and other individual parts are configured without a hole. It is possible to achieve by a corresponding choice of dimensions of the individual parts that, when the individual parts are assembled differently, the hole can be provided at different positions.

In a further exemplary embodiment, the rear wall 34 can be configured in two parts with an upper and a lower part, wherein the upper part can be pushed upwardly in the manner of a roller shutter and the lower part can be pushed downwardly in the manner of a roller shutter. Thus a dividing line can be displaced vertically between the parts in order to permit the line 35 to be guided out at the dividing line in all positions of the support part 1.

In a further exemplary embodiment, the rear wall 34 can be configured in multiple parts, with at least two fixed parts which permit a window therebetween and a horizontally displaceable part covering the window and overlapping the fixed parts. If the hole is introduced into the horizontally movable part, the position of the hole can be adapted again to the position of the support part.

In further exemplary embodiments, combinations of these options can be implemented.

In a further exemplary embodiment, the actuating element 28 is not arranged on the support part 1 but remotely therefrom, for example in a vanity unit 36.

In this case, the actuating element 28 can be coupled via a mechanical coupling 29 or any other, for example electronic, coupling to the valve 19, in particular to the pilot valve 24. Alternatively, the pilot valve 24 can be separated from the principal valve 25 and connected thereto via a control line 26. The pilot valve 24 can be directly arranged in this case on the actuating element 28.

The control line can be arranged in this case in a control line conduit, for example on the rear face, which can be configured in a similar manner to the line conduit already described above.

Thus the valve 19 can be arranged on the support part 1 and coupled to the remote actuating element 28.

Alternatively, the valve 19 can be arranged in or on the vanity unit 36 or in or on the wash basin 32 and connected via a long connection line 12 to the liquid outlet 9.

Alternatively, the principal valve 25 can be arranged in the support part 1 and the pilot valve 24 can be arranged outside the support part 1, for example in or on the vanity unit 36 or in or on the wash basin 32. The pilot valve 24 is in this case operatively connected to the principal valve 25 via the control line 36.

In further exemplary embodiments, the support part 1 is configured as a floor of the body 17 and the piece of furniture 3 is arranged for use above a wash basin or a bath or shower tray.

In a support part 1 according to the invention, therefore, it is proposed to arrange a liquid outlet 9 on an outer face 4 or 5 of the support part 1, wherein the liquid outlet 9 preferably leads outwardly on the lower face 5 of the support part 1.

LIST OF REFERENCE NUMERALS

1 Support part
2 Shelf
3 Piece of furniture
4 Upper face
5 Lower face
6 Upper part
7 Lower part
8 Liquid conduit arrangement
9 Liquid outlet
10 Holder of 9
11 Receiver in 10 for 9
12 Connection line
13 Angled piece
16 Fitted shelf
17 Body
18 Actuating mechanism
19 Valve
20 Fastening interface at 19
24 Pilot valve
25 Principal valve
26 Control line
27 Pressure chamber
28 Actuating element
29 Mechanical coupling
30 Control rod
31 Front outer face of 1
32 Wash basin
33 Wall
34 Rear wall
35 Line
36 Vanity unit
38 Pipe

The invention claimed is:

1. A support assembly for a piece of furniture (3), the support assembly comprising: a support part (1) configured to be arranged in a height adjustable manner on the piece of furniture (3), and a liquid outlet (9) arranged at least indirectly on an outer face (4, 5) of the support part (1).

2. The support assembly as claimed in claim 1, wherein at least one of a) the liquid outlet (9) is arranged by a holder (10) on the outer face (4, 5) of the support part (1) or b) the liquid outlet (9) is arranged entirely outside an of the support part (1).

3. The support assembly as claimed in claim 1, further comprising a connection line (12) to the liquid outlet (9) or a liquid outlet, which at least in some portions is arranged on the outer face (4, 5) of the support part (1).

4. The support assembly as claimed in claim 3, wherein a line conduit is configured in the support part (1), with a portion of the connection line (12) being arranged therein.

5. The support assembly as claimed in claim 1, wherein at least one of a) the support part (1) is plate-shaped, b) the support part (1) is releasably connected to a body (17) of a piece of furniture (3), or c) the support part (1) is arranged movably (17).

6. The support assembly as claimed in claim 1, wherein the support part (1) is configured as part of a body (17) of a piece of furniture (3).

7. The support assembly as claimed in claim 6, further comprising an actuating mechanism (18) for a valve (19) blocking or opening the at least one connection line (12) arranged on the piece of furniture (3).

8. The support assembly as claimed in claim 1, wherein at least one of a) a valve (19) is fastened to the support part (1), or b) the valve is connected to the liquid outlet (9) via a flexible hose (20).

9. The support assembly as claimed in claim 1, wherein the support part (1) is produced from at least one of wood or wood fibers or is at least laminated on the outer face with wood or contains wood.

10. The support assembly as claimed in claim 1, further comprising a valve (19) in fluid communication with the liquid outlet, and an actuating mechanism (18) that has a pilot valve (24) configured to control a principal valve (25) of the valve (19).

11. The support assembly as claimed in claim 10, wherein at least one control line (26) of the pilot valve (24) is arranged on the outer face (4, 5).

12. The support assembly as claimed in claim 1, further comprising a valve (19) in fluid communication with the liquid outlet, and an actuating element (28) of the valve (19) or a pilot valve (24) is guided outwardly in the support part (1), on a side edge (31) of the support part (1).

13. The support assembly as claimed in claim 1, wherein the liquid outlet is a water outlet.

14. A construction kit for a piece of furniture having at least one said support assembly as claimed in claim 1.

15. A piece of furniture (3) having at least one said support assembly as claimed in claim 1, wherein the support part (1) is arranged horizontally.

16. The piece of furniture (3) as claimed in claim 15, further comprising a wash basin (32) arranged below the support part (1).

17. The piece of furniture (3) as claimed in claim 15, further comprising a valve (19) connected to a water removal point via a line (35) laid in or behind a wall (33) -of the piece of furniture (3).

18. The piece of furniture (3) as claimed in claim 15, wherein the support part (1) comprises a shelf.

19. A piece of furniture (3) having at least one said support assembly, the support assembly comprising: a support part (1), and a liquid outlet (9) arranged at least indirectly on an outer face (4, 5) of the support part (1), wherein the support part (1) is arranged horizontally, further comprising the support part (1) being arranged in a height adjustable manner on the piece of furniture (3).

* * * * *